United States Patent [19]

Stein

[11] 4,003,682

[45] Jan. 18, 1977

[54] ROTARY PISTON ENGINE HAVING CONTINUOUS TORQUE CHARACTERISTICS

[76] Inventor: John William Stein, 5 Falcon Road, Flanders, N.J. 07836

[22] Filed: July 14, 1975

[21] Appl. No.: 595,393

[52] U.S. Cl. ..... 418/107; 418/110; 418/173; 418/187

[51] Int. Cl.[2] ..... F01C 19/00; F01C 1/00; F04C 1/00

[58] Field of Search ..... 418/107–110, 418/173, 186–188, 104, 135

[56] References Cited

UNITED STATES PATENTS

| | | | |
|---|---|---|---|
| 155,160 | 9/1874 | Klein | 418/173 |
| 822,347 | 6/1906 | Clark | 418/173 |
| 1,263,550 | 4/1918 | Gollings | 418/173 |
| 1,309,871 | 7/1919 | Allen | 418/173 |
| 1,496,704 | 6/1924 | Caminez | 418/173 |
| 1,528,075 | 3/1925 | Richer | 418/173 |
| 2,004,920 | 6/1935 | Belden | 418/107 |
| 2,394,185 | 2/1946 | Jaworowski et al. | 418/173 |

FOREIGN PATENTS OR APPLICATIONS

| | | | |
|---|---|---|---|
| 1,026,523 | 2/1953 | France | 418/173 |
| 649,238 | 8/1928 | France | 418/173 |
| 489,760 | 1/1930 | Germany | 418/173 |
| 756,958 | 9/1956 | United Kingdom | 418/173 |

*Primary Examiner*—John J. Vrablik
*Attorney, Agent, or Firm*—Cantor and Singer

[57] ABSTRACT

A rotary piston engine is disclosed of a novel, geometric construction whereby substantially pressure dependent operation is ensured along with continuous torque characteristics. In the preferred inventive embodiment, an elongated rotatable shaft having a disc plate intermediate thereof is provided with a pair of rotor assemblies disposed to either side of the disc plate and attached for rotation as a unit, each rotor assembly including an inner and an outer concentrically arranged ring of different diameters with a radially extending piston vane disposed therebetween in linking relationship therewith. A slotted intermediate ring is placed between the inner and outer rings of each respective rotor assembly, the intermediate ring being journalled off-center of its respective rotor assembly such that the intermediate ring effects a rolling contact seal with both the inner and outer rings of the rotor assembly during rotation thereof. The arrangement is such that a plurality of crescent-shaped sealed chambers of varying volume are formed between the intermediate and outer rings, and between the intermediate and inner rings of each rotor assembly as the shaft rotates, with the radial vane of each rotor assembly dividing the respective chambers into sectors. A fluid inlet means communicates with such sectors disposed to one side of each radial vane and a fluid outlet means communicates with the chamber sectors disposed to the other side of each radial vane. The device can be operated as both a motor and as a pump.

5 Claims, 9 Drawing Figures

| MOTOR | PUMP |
|---|---|
| HIGH PRESSURE | LOW PRESSURE |
| LOW PRESSURE | HIGH PRESSURE |

ROTARY PISTON ENGINE HAVING CONTINUOUS TORQUE CHARACTERISTICS

BACKGROUND OF THE INVENTION

This invention generally relates to rotary machines and is particularly concerned with the provision of a rotary piston engine which can be operated as either a motor or as a pump.

The prior-art is replete with various forms of engines of the type which serve to convert energy into rotary motion. The most common engine of this general type is the steam engine which can be constructed either as a rotary turbine, or as a reciprocating piston-type engine, all as is well known. While many forms of such engines have been constructed, certain problems common to engines of these basic types exist and have not been resolved in the prior-art.

For example, present rotary steam turbines are generally dependent upon the velocity of the incoming steam source and require relatively high steam temperature and pressure to bring about adequate operation. Due to the high pressure and temperatures involved, problems occur with respect to effecting a positive technique of sealing the turbine blades which blades, in and of themselves, are typically of rather intricate construction. Further, present steam turbines are only about forty percent efficient with respect to the conversion of the incoming energy source, i.e., steam, to rotational motion. The reciprocating-piston-type of steam engine is dependent for its operation upon the pressure of the incoming steam or fluid source but, due to the construction thereof, exhibits a relatively high amount of energy loss in the form of friction and further is incapable of the high speed associated with engines of the turbine type. Additionally, a reciprocating-piston-type of steam engine consumes a relatively large volume of steam, as does the rotary turbine.

Designers of modern steam or fluid engines generally are constrained to elect either the rotary turbine variety, or the reciprocating-piston-type of machine and consequently, present-day engine design involves a trade-off and compromise of the advantages and disadvantages associated with each engine type.

SUMMARY OF THE INVENTION

It is the primary objective of the instant invention to provide a rotary engine, particularly an engine operable by a fluid source such as steam, which exhibits the constructional features and advantages of both the conventional rotary turbine, as well as the reciprocating-piston-type engine, this objective being achieved through the provision of an entirely new engine design.

A further objective of the instant invention is to provide a rotary engine which, rather than utilizing turbine blades, utilizes a piston-like arrangement and which exhibits a positive method of sealing its blades or pistons so as to bring about the same pressure-dependent advantages associated with conventional piston engine constructions.

Another objective of the instant invention is to provide a rotary piston engine of novel construction and which will exhibit continuous torque characteristic.

Yet another objective of the instant invention is to provide a rotary piston engine which contains a minimum of moving parts and which is constructed in a fashion such that friction between such parts is reduced.

Still another objective of the instant invention is to provide a rotary piston engine constructed as to have seals between the moving parts thereof which are self-adjusting during operation, thereby minimizing thermal expansion problems, eliminating critical adjustments, and allowing manufacture of the device without regard to close tolerances.

Another objective of the instant invention is the provision of a rotary piston engine which is capable of operation either as a motor and/or as a pump.

A further objective of the instant invention is the provision of a rotary piston engine having a plurality of rotor assemblies which can separately be utilized such that one assembly functions as a motor, for example, while the other assembly functions as a pump.

These objectives, as well as others which will become apparent as the description proceeds, are implemented by the instant inventive rotary piston engine which incorporates an elongated rotatable shaft having a generally circular disc plate intermediate thereof. An individual rotor asssembly is carried about the shaft at least to one side of the disc plate and is attached thereto for rotation therewith as a unit. Each of the rotor assemblies include an inner and an outer concentrically arranged ring of different diameters with a radially extending piston vane disposed therebetween in linking relationship therewith.

An intermediate ring is provided for each of the separate rotor assemblies, the intermediate ring having a diameter which is intermediate of the inner and outer rings of a respective rotor assembly. The intermediate ring is provided in abutting sliding relationship with the disc plate and is slotted so as to accept the piston vane of the respective rotor assembly.

The basic assembly is completed by the provision of end plate means through which each end of the shaft is disposed, the end plate means serving to journal each intermediate ring off-center of a respective rotor assembly and the shaft such that the intermediate ring effects a rolling contact seal with both the inner and outer rings of a respective rotor assembly during rotation of the rotor assembly and the shaft, with the inner and outer rings of a respective rotor assembly being in an abutting sliding relationship with each end plate means.

With the geometry above-described, it wll be apparent that a plurality of crescent-shaped sealed chambers of varying volume are formed between the intermediate and outer rings, and between the intermediate and inner rings of each respective rotor assembly as the respective rotor assembly and shaft is turned, with the radial vane of each rotor assembly serving to divide the respective chambers into sectors which are disposed to either side thereof.

Fluid ports are provided so as to communicate with the chamber sectors, one set of ports being disposed to one side of each radial vane whereas another set of ports is disposed to the other side of each radial vane. The ports provide respective inlet means and outlet means through which a fluid can be applied or exhausted. The varying chamber volume effected during rotation of the device can effect a pumping action or, alternatively, can be utilized within the format of a motor as is desired.

In that the engine of the instant invention is of rotary construction, high speed operation is possible much in the fashion of a turbine, for example. Yet, the disadvantages of turbines are eliminated in that the engine of the instant invention is not dependent upon the velocity of the incoming fluid nor does the engine of the instant invention utilize an intricate blade structure. Rather, the preferred embodiment of the inventive device incorporates but a single piston vane in each rotor assembly such that operation of the engine is dependent upon the pressure of the incoming fluid source in a fashion so as to provide continuous torque characteristics. In addition, the novel geometry of the crescent-shaped chambers and the sectors thereof is such as to ensure operation of the engine at high efficiency and with a consumption of a relatively low fluid volume.

BRIEF DESCRIPTION OF THE DRAWINGS

The invention will be better understood and further features and advantages thereof will become apparent from the following detailed description of a preferred embodiment, such description making reference to the appended drawings, wherein.

DETAILED DESCRIPTION OF THE PREFERRED INVENTIVE EMBODIMENT

Figure 1:
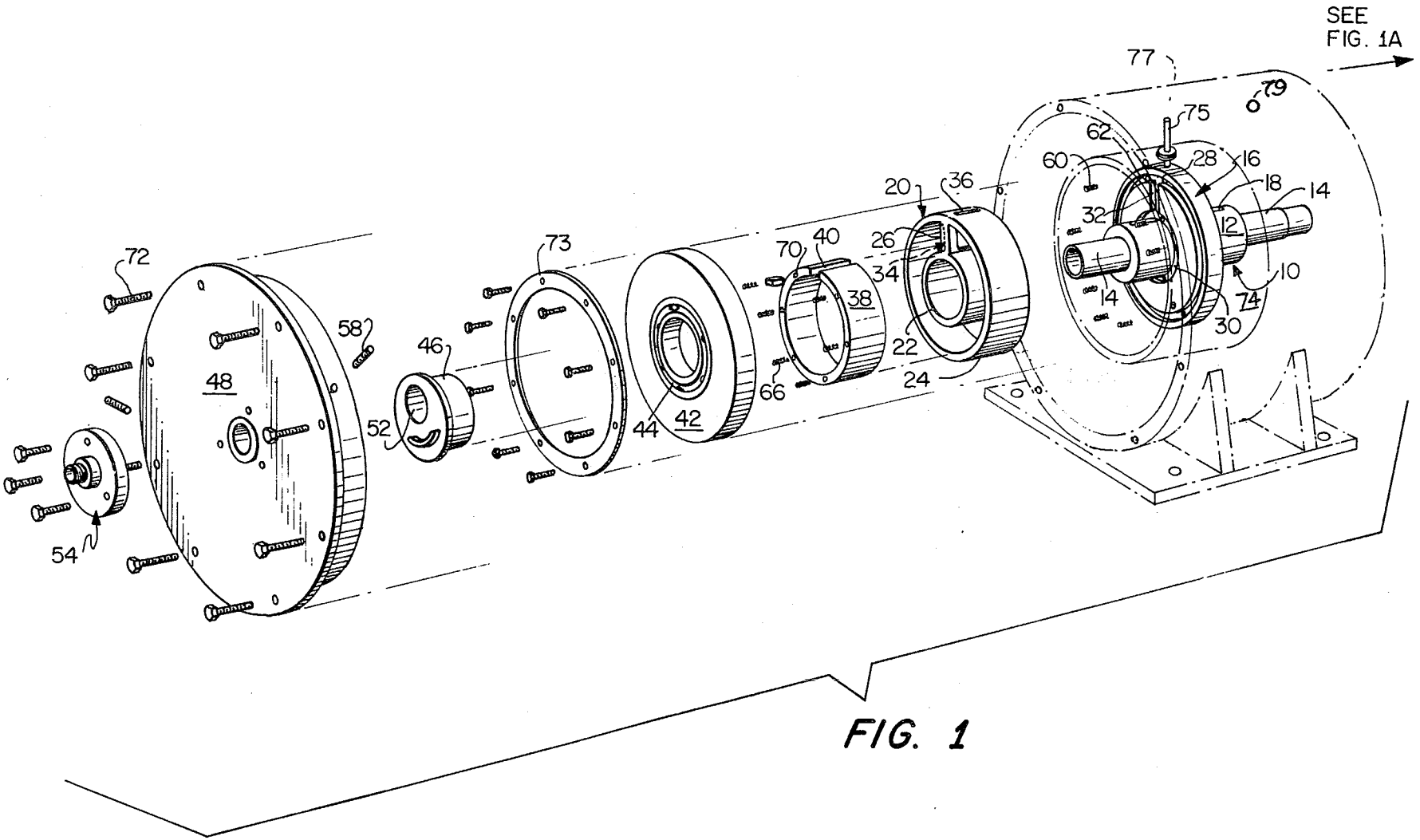
FIGS. 1 and 1A are an exploded perspective illustration of the various parts constituting the rotary piston engine constructed in accordance with the basic teachings of the instant invention.
Figure 1A:
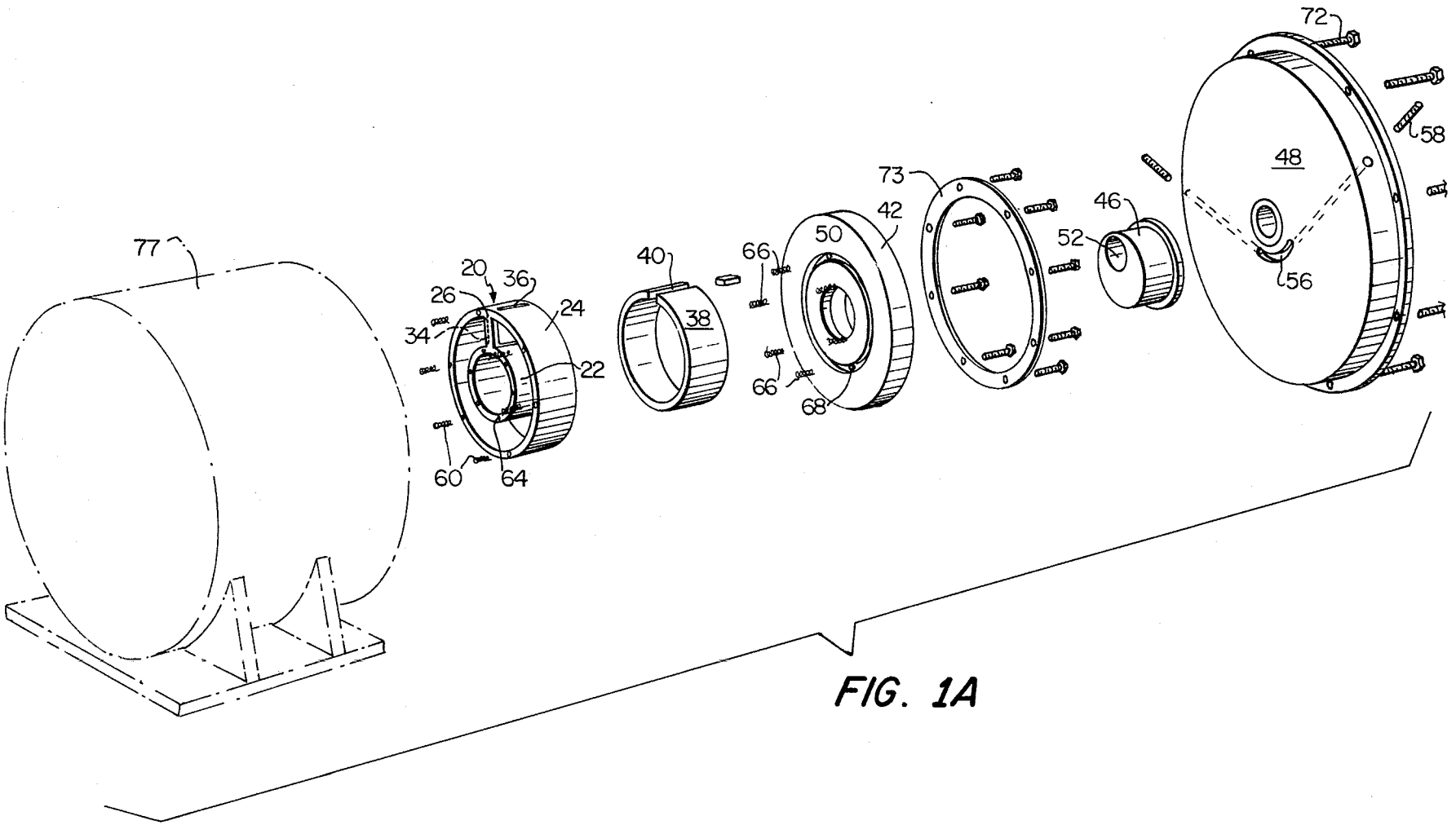
Figure 2:
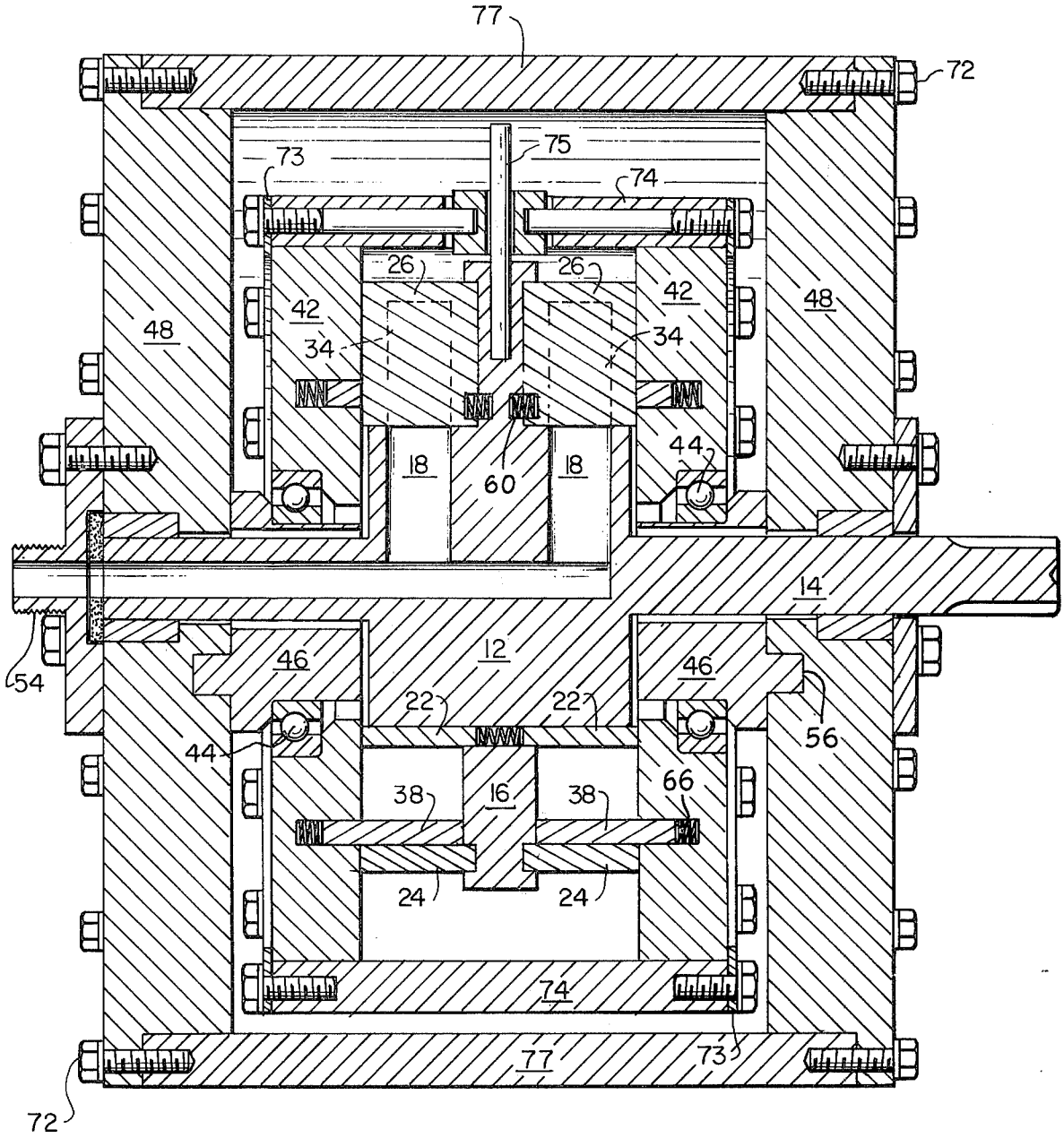
FIG. 2 is an elevational view, in section, of an assembled rotary piston engine constructed in accordance with the inventive teachings; and FIGS. *3a* thru *3f* are schematic illustrations serving to illustrate the operation of the rotary piston engine of the instant invention during one complete rotational cycle thereof.

Reference is now made to FIGS. 1 and 2 of the application drawings wherein like parts are depicted by the same numerals for ease in comprehension.

The rotary piston engine of the instant invention will be seen to comprise an elongated shaft 10 having a central portion 12 of somewhat enlarged diameter as contrasted with the diameter of end portions 14 as is shown. A disc plate 16 of generally circular construction is disposed about the central portion 12 of shaft 10 intermediate the shaft ends, disc plate 16 being preferably constructed such that the elongated shaft 10 and disc plate 16 are integral. In the preferred inventive embodiment, the elongated shaft 10 is of hollow construction at least along half its length and includes a slot which communicates with the hollow interior thereof such that a fluid inlet channel is created between at least one end of the shaft 10 and slot 18 for purposes as will be described hereinbelow.

A rotor assembly generally designated by reference numeral 20 is adapted to be carried about shaft 10 to either side of the disc plate 16. Each rotor assembly 20 includes an inner and an outer concentrically arranged ring 22 and 24, respectively, of different diameters, a radially extending piston vane 26 being disposed between the inner and outer rings in linking relationship therewith. The entire rotor assembly 20 comprises the inner and outer rings 22, and 24 respectively, and the linking radially extending piston vane 26 constitutes an integral unit which is adapted to rotate together with the elongated shaft 10 and the disc plate 16.

To this end, it should be noted that the disc plate 16 includes a pair of circumferential channels 28 and 30 respectively, to either side of such disc plate, and a radial channel 32 linking circumferential channels 28 and 30 and again being disposed on each of the two opposite sides of the disc plate 16. Circumferential channels 28 and 30 and radial channels 32 are adapted to receive the outer and inner rings 24 and 22, respectively, and the piston vane 26 of each of two rotor assemblies 20, the rotor assemblies 20 being fitted over the enlarged diameter central portion 12 of the shaft 10 to either side of the disc plate 16 as can best be seen in FIG. 2 of the application drawings.

It should further be noted that the piston vane 26 of each rotor assembly 20 contains a slotted or grooved portion 34 on one side which communicates between the slot 18 provided in the elongated shaft 10 and the one side of the vane 26 to provide an inlet port, so that fluid flow between one end of the elongated shaft 10 and the interior of the rings of each rotor assembly 20 takes place. A further slotted portion 36 on the other side of the piston vane 26 provides an exhaust port in the fashion to be discussed hereinbelow.

Each rotor assembly 20 is further provided with an intermediate ring 38 of a diameter intermediate of the diameter of the inner and outer rings 22 and 24 of the rotor assembly. The intermediate ring 38 of each rotor assembly 20 is disposed intermediate of the inner and outer rings 22 and 24, respectively, in an abutting and sliding relationship with the disc plate 16. As shown, each intermediate ring 38 is slotted as at 40 so as to accept the piston vane 26 of each said respective rotor assembly 20.

Each intermediate ring 38, while disposed so as to be intermediate of the inner and outer rings 22 and 24 of the rotor assembly 20, is journalled off-center of its respective rotor assembly through the provisions of respective end plate means which will be seen to comprise a further circular disc 42 which may be journalled by roller bearings 44, for example, about a stub shaft 46 of an end plate 48. The surface of the disc 42 which faces each respective rotor assembly 20 contains a circumferential groove 50 adapted to receive the intermediate ring 38 of each rotor assembly. Disc 42 is itself clamped to a cylindrical sleeve member 74 for rotation therewith by the circular clamping ring 73, the cylindrical sleeve 74 being coupled for rotation with disc plate 16 by a pin 75 attached to plate 16 and extending through an aperture in the sleeve 74, the pin further serving to align the angular position of the intermediate ring 38 with the rotor assembly 20.

It should further be noted that the stub shaft 46 of each end plate 48 contains an oversized throughbore 52 which is disposed off-center and into which loosely fits the end portion 14 of the elongated shaft 10. The throughbore 52 terminates externally of each plate 48 in a further bearing and fluid coupling arrangement 54. For adjustment purposes as will be explained hereinbelow, the mounting of the stub shaft 46 on end plate 48 is adjustable along an arcuate path or slot 56, stub shaft 46 being maintained in a selected position along the arcuate path 56 by means of adjustment screws 58. The arcuate path or slot 56 is an arc of a circle having its center on the outside surface of ring 22 and having a radius extending from such center through the rotational axis of ring 22, (i.e., the axis of rotation of shaft 14 or the centerline of the assembly) to the rotational axis of the intermediate ring 38, (i.e., the off-centerline of the assembly).

Figure 3A:
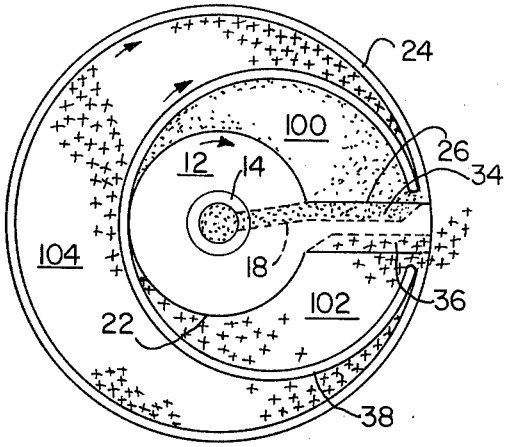
Figure 3B:
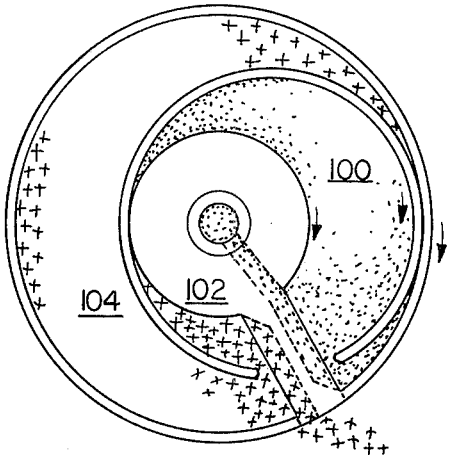
Figure 3C:
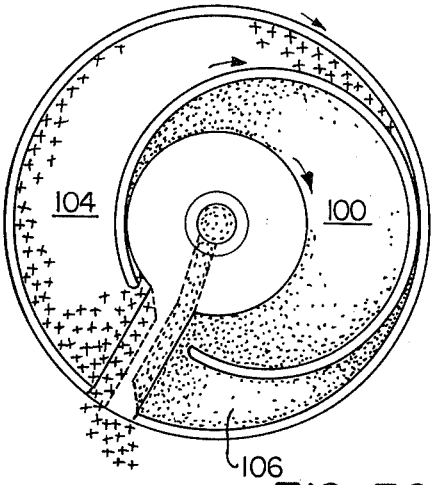
Figure 3D:
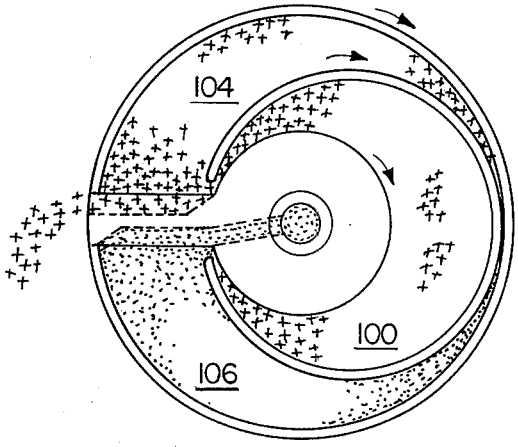
Figure 3E:
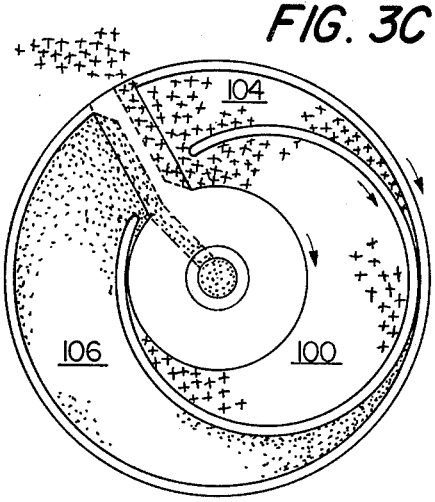
Figure 3F:
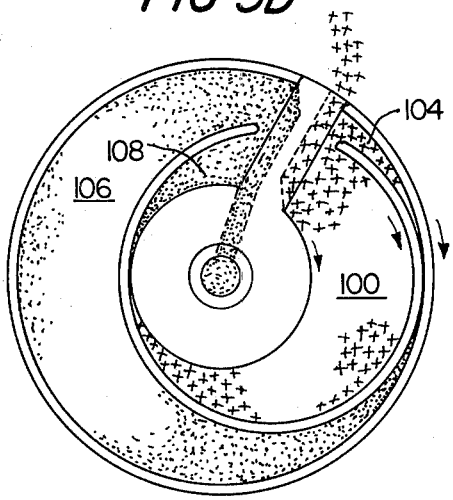

When the rotary piston engine of the instant invention and as depicted in FIG. 1 is assembled such as is shown in FIG. 2, the relationship of the intermediate ring 38 with respect to inner and outer rings 22 and 24 and the piston vane 26 of each rotor assembly 20 is as shown in FIGS. 3A–3F of the drawings, it being noted that no contact need exist as between the piston vane and the intermediate ring. Specifically, the relationship of these elements as is shown in FIG. 3D can be directly correlated with the rotational positions of the elements depicted in the perspective illustration of FIG. 1.

With reference now to FIGS. 3A–3F of the drawings, it should be noted that the off-set journalling of the intermediate ring 38 of each rotor assembly 20 is such that the intermediate ring 38 effects a rolling contact seal with both the inner and outer rings 22 and 24 of each rotor assembly 20 during rotation of the rotor assembly and shaft. A plurality of crescent-shaped sealed chambers of varying volume are formed between the intermediate and outer rings, and between the intermediate and inner rings as the rotor assemblies and shaft rotate, with the radial piston vane 26 of each rotor assembly serving to divide such respective chambers into sectors disposed to either side thereof. Each chamber and sector are sealed, top and bottom, by disc 42 into which the intermediate ring 38 is received and upon the surface of which rotor assembly 20 makes sliding contact, and by disc 28 into which is received the rotor assembly 20 and upon the surface of which the intermediate ring 38 makes sliding contact.

To ensure that such top and bottom seals remain intact during operation of the machine, self-adjusting mechanisms are provided by which wear of the parts is automatically compensated for, and by which thermal expansion of the elements is tolerated. Specifically, and again wih reference to FIGS. 1 and 2 of the application drawings, it should be noted that compression springs 60 are disposed in each circumferential channel 28 and 30, such compression springs 60 serving to outwardly bias the rotor assembly 20 so as to ensure abutting contact of such rotor assembly with the facing side of disc 42 above-described, compression springs 60 being maintained in position by orifices 62 provided in the circumferential grooves 28 and 30 of disc 16 on the one hand, and by orifices 64 provided in the facing surfaces of the inner and outer rings 22 and 24 of each rotor assembly 20.

Similarly, compression springs 66 are disposed in apertures 68 of the circumferential ring 50 of each disc 42, such compression springs terminating at their other end in apertures 70 of the intermediate ring 38 and serving to inwardly bias each intermediate ring 38 thereby ensuring abutting contact thereof with each side of the disc plate 16. Lastly, and as briefly discussed above, the position of the axis of rotation of intermediate ring 38, i.e., the amount "offset" with respect to the axis of rotation of the elongated shaft 10, can be adjusted by moving the stub shaft 46 along an arcuate path defined by slot 56 in each plate 48, to thereby compensate for frictional wear on the internal surfaces of inner and outer rings 22 and 24 and intermediate ring 38 to maintain the rolling contact seal therebetween.

The entire assembly is disposed in a housing 77 by bolts 72 which pass through the end plates 48 into the ends of the cylindrical housing 77 disposed therebetween, housing 77 having an exhaust port 79 therethrough.

With reference now to FIGS. 3A–3F of the drawings, the operation of the novel rotary piston engine of the instant invention will be described. Again, for ease in understanding, like parts have been identified with the same reference numerals. With reference now to FIG. 3A of the drawings, the operation of the device as a turbine or motor will first be described, and as aforementioned, the fluid inlet adapted to receive steam or some other fluid under pressure will be considered to constitute the hollow shaft 14, slot 18 communicating therewith, and groove 34 disposed in one side of the radial piston vane 26 of each rotor assembly. The exhaust port by which fluid can exit will be construed to be slot 36 disposed in the outer ring 24 of each rotor assembly 20 and which communicates with the other side of the radial vane 26 by means of a further groove formed therein as is illustrated by the dotted-line in FIG. 1.

Thus, fluid which may contain graphite or oil therein for lubrication, is supplied through the hollow shaft 14, through the slot 18 therein and out the groove 34 in one side of the radial vane 26 so as to fill sector 100 with fluid under high pressure, such pressure thereby being applied against the side of the piston vane 26 facing sector 100 whereby a rotary torque is produced. Sectors 102 and 104 meanwhile would be vented to atmosphere through groove 36 communicating with its associated slot provided on the other side of the radial piston vane 26. Thus, all rings of the device would tend to rotate in the clockwise direction as is indicated by the arrows, effecting a clockwise rotation of the shaft 14 to which would be coupled a load. FIG. 3B depicts the device as it continues to rotate, illustrating that chamber 100 is growing in volume, while chamber 102 is shrinking in volume.

With continued rotation as is shown in FIG. 3C, chamber 100 has grown to increased volume and further, a new chamber 106 has been formed to which is also applied the fluid under pressure. Chamber 102 has effectively been eliminated, and chamber or sector 104 still constitutes the low pressure side of the apparatus.

During further rotation of the apparatus, chamber 100 becomes cut-off or sealed from the input of the high pressure and at the same time, a passageway opens between chamber 100 and the other side of the radial vane 26 communicating with the exhaust port 36, thus allowing chamber 100 to exhaust. Meanwhile, chamber or sector 106 continues to receive the high pressure fluid inlet which presses against the facing side of piston 26 and continues the rotational torque. Chamber 104 continues to exhaust.

As rotation continues, chambers 104 and 100 further continue to exhaust and it should be noted that chamber 104 is losing volume and shrinking in size, while chamber 106 continues to constitute the high pressure side of the apparatus.

During still further rotation, a new chamber 108 on the high pressure side of the apparatus begins to form, while on the low pressure side of the apparatus, chamber 100 continues to exhaust and chamber 104 substantially disappears. In the description of these figures as set forth above the plusses (+) represents the low pressure side of the apparatus, whereas the dots (. . . ) represent the high pressure side of the apparatus as is indicated.

If the device were to be operated as a pump, a means of motive power would be attached to the end of shaft 14 causing the engine to turn. The low pressure side of the pump and the high pressure side of the pump would thereby be reversed from that described above.

Many modifications of the device as above-described are contemplated, all within the scope of the invention.

For example, it is not necessary in all instances that the fluid inlet be provided through the hollow elongated shaft. Rather, the fluid inlet could be provided through an orifice disposed in disc 42, for example. Similarly, a further orifice could be provided in disc 42 to constitute the exhaust port, thus eliminating slot 36 and its associated groove in the radial piston vane 26.

Additionally, and in the embodiment described, both "sides" of the machine, constituting the separate rotor assemblies 20, are illustrated as being physically aligned such that the respective radially extended piston vanes 26 thereof are superimposed one above the other and the machine is "in phase." As can be appreciated, operation of the machine in this fashion is not critical in that the two separate rotor assemblies may be rotationally displaced one from the other such that the location of the radially extended piston vanes are not co-extensive. In this fashion and with elimination of pin 75 as will be described below, "out of phase" operation can be achieved.

Further, and as can be appreciated, through simple modifications of the inlet and outlet ports, it is possible to operate the apparatus of the instant invention such that one rotor assembly 20 functions in the turbine or motor mode, while the other rotor assembly functions as a pump or compressor.

In another variant of the invention, pin 75 can be eliminated. In this instance, driving contact would then exist as between the piston vane 26 and the slot 40 of the intermediate ring 38.

The rotary piston engine of the instant invention effectively combines the advantageous properties of conventional turbine and reciprocating steam engines, while serving to eliminate the disadvantages of both.

It should therefore be apparent that the objectives set forth at the outset of this specification have been successfully achieved.

What is claimed is:

1. In a rotary machine of the type having inner and outer concentric rings disposed about a first axis and an intermediate ring disposed about a second offset axis for rotation therewith in which said intermediate ring makes a rolling contact seal with both said inner and outer rings to define a plurality of crescent-shaped chambers of varying volume therebetween, the improvement comprising means for adjustably moving said second axis relative to said first axis along an arcuate path constituted by an arc of a circle having its center on the outside surface of said inner concentric ring and having a radius extending from said center through said first axis to said second axis, whereby frictional wear between said rings is compensated and the maintenance of said rolling contact seal is ensured.

2. In a rotary machine of the type having inner and outer concentric rings disposed about a first axis and an intermediate ring disposed about a second offset axis for rotation therewith in which said intermediate ring makes a rolling contact seal with both said inner and outer rings to define a plurality of cresent-shaped chambers of varying volume therebetween, the improvement wherein said rings are disposed between two plates such that said inner and outer rings abut against one of said plates, and said intermediate ring abuts against the other of said plates, said inner and outer rings further being slidably disposed in a pair of circumferential channels in said other of said plates so as to be movable in said channels in a direction normal to the side of said other plate, biasing means disposed in said channels for outwardly biasing said inner and outer rings thereby ensuring said abutting contact with said one plate; and wherein said intermediate ring is slidably disposed in a circumferential channel in said one plate for movement in a direction normal to said one plate, biasing means being disposed in said last-mentioned channel for biasing said intermediate ring in a direction opposite to the direction of biasing of said inner and outer rings to thereby ensure abutting contact of said intermediate ring with said outer plate.

3. In a rotary piston engine of the type including an elongated rotatable shaft having a disc plate intermediate thereof, a rotor assembly carried about the shaft at least to one side of the disc plate and coupled thereto for rotation therewith as a unit, the rotor assembly including an inner and an outer-concentrically arranged ring of different diameters with a radially extending piston vane disposed therebetween in linking relationship therewith, an intermediate ring for the rotor assembly having a diameter intermediate of and being disposed intermediate of the inner and outer rings of the rotor assembly in abutting sliding relationship with the disc plate, the intermediate ring being slotted to accept the vane of the rotor assembly, end plate means through which each end of the shaft is disposed, the end plate means journalling the intermediate ring offset of the rotor assembly and the shaft such that the intermediate ring effects a rolling contact seal with both the inner and outer rings of the rotor assembly during rotation of the rotor assembly and the shaft, the inner and outer rings of the rotor assembly being in an abutting sliding relationship with the end plate means, the arrangements being such that a plurality of crescent-shaped sealed chambers of varying volumes are formed between the intermediate and outer rings and between the intermediate and inner rings as the rotor assembly and the shaft rotates, the radial vane of the rotor assembly dividing the respective chambers into sectors disposed to either side thereof, wherein inlet means are provided communicating with the chamber sectors disposed to one side of the radial vane through which a fluid can be applied, and wherein outlet means are provided communicating with the chamber sectors disposed to the other side of the radial vane through which a fluid can be exhausted, the improvement comprising;

a pair of circumferential channels and a radial channel disposed on a side of said disc plate into which channels are slidably received said inner and outer rings and said radial vane respectively, of said rotor assembly, said rotor assembly being movable in said channels in a direction normal to the side of said disc plate, and biasing means disposed in said channels for outwardly biasing said rotor assembly thereby ensuring abutting contact thereof with the respective end plate means; and wherein said intermediate ring is slidably received in a circumferential channel disposed in said end plate means for movement in a direction normal to said end plate means, biasing means being disposed in said channel of said end plate means for inwardly biasing said intermediate ring thereby ensuring abutting contact thereof with the side of said disc plate, whereby compensation is automatically provided for thermal expansion, wear, and manufacturing tolerances of the rotor assembly and intermediate rings.

4. The improvement is defined in claim 3 wherein said end plate is itself journalled for rotation upon an axis offset from the axis of said shaft.

5. The improvement defined in claim 3, including means for adjusting the position of said journalling axis of said end plate means to ensure a rolling contact seal between said intermediate ring and said inner and outer rings of said rotor assembly.

* * * * *